United States Patent [19]

Wentworth et al.

[11] Patent Number: 4,715,287

[45] Date of Patent: Dec. 29, 1987

[54] VEHICLE CONVEYOR AND WHEEL ENGAGING DOLLY

[75] Inventors: Robert J. Wentworth, Northville; Graham J. Astley, Novi, both of Mich.

[73] Assignee: Belanger, Inc., Northville, Mich.

[21] Appl. No.: 1,595

[22] Filed: Jan. 8, 1987

[51] Int. Cl.[4] ..... B61B 10/04; B61B 13/12; B65G 17/24; B65G 19/26

[52] U.S. Cl. ..... 104/172.3; 198/732

[58] Field of Search ..... 104/172.3, 172.1, 165, 104/162; 198/717, 722, 725, 732

[56] References Cited

U.S. PATENT DOCUMENTS

| | | | |
|---|---|---|---|
| 30,026 | 6/1860 | Hanna et al. | 104/172.3 |
| 795,124 | 7/1905 | Hetzel | 104/172.3 |
| 3,058,433 | 0/1962 | Hurst | 104/172.3 |
| 3,225,896 | 12/1965 | Krueger et al. | 198/732 |
| 3,260,219 | 7/1966 | Vani | 104/172.3 |
| 3,329,255 | 0/1967 | Dulieu | 198/732 |
| 3,403,635 | 10/1968 | Smith | 104/172.3 |
| 3,554,132 | 1/1971 | Hanna | 104/172.3 |
| 3,554,133 | 1/1971 | De Angelis | 104/172.3 |
| 4,266,482 | 3/1981 | Barber | 104/172.3 |
| 4,374,496 | 2/1983 | Hanna | 104/172.3 |
| 4,576,098 | 3/1986 | Belanger | 104/172.3 |

FOREIGN PATENT DOCUMENTS

| | | |
|---|---|---|
| 49256 | 2/1965 | Poland . |
| 866104 | 4/1961 | United Kingdom . |

*Primary Examiner*—Robert B. Reeves
*Assistant Examiner*—Thomas W. Kearns
*Attorney, Agent, or Firm*—Cullen, Sloman, Cantor, Grauer, Scott & Rutherford

[57] ABSTRACT

A conveyor for transporting a vehicle through a car wash along a track having specially-adapted, low profile roller dollies which rise upon contacting a vehicle wheel. The dolly includes an arcuate arm which is hinged to a connector link on one end and supports three pair of rollers. The first pair of rollers is connected to the arm below the track and the second pair of rollers is connected to the opposite end of the arm from the first pair and is positionable above the track to ride upon the top surface of the track. The third pair of rollers is intended to engage the wheel of the vehicle to be moved along the track and is located on the arm between the two ends at a position radially spaced from the concave arc upon which the first and second pairs of rollers are aligned. The third pair of rollers rolls upwardly and rearwardly upon contacting a vehicle wheel and pivots the arm about the second pair of rollers. The pivoting movement of the arm causes the first pair of rollers to pivot until they engage the lower surface of the track.

10 Claims, 5 Drawing Figures

64
11
10
41
44
43
40
41
44
12
60
62
31
38
37
38
30
66
51
47
35
14
55
41
14
41
70
70
38
31
44
68
66

VEHICLE CONVEYOR AND WHEEL ENGAGING DOLLY

TECHNICAL FIELD

The present invention relates to conveyors for moving objects on a track and more particularly relates to vehicle conveyors for car washes having dollies, roller mechanisms or pushers which engage vehicle wheels.

BACKGROUND OF THE INVENTION

Vehicle conveyors used in car washes are well known and form an important part of a car wash system. Car wash conveyors must be rugged and dependable. They also must be suitable for use in the harsh car wash environment wherein water, detergent and dirt are constantly in contact with the conveyor and its component parts.

One example of a car wash conveyor is disclosed in U.S. Pat. No. 4,576,098 to Belanger et al., issued Mar. 18, 1986, which is owned by the assignee of the present application. The conveyor includes a framework in which there is provided an endless sprocket chain conveyor assembly having thereon a series of longitudinally spaced roller dollies (also called roller mechanisms or pushers) which for normal operation are movably positioned within the framework below a top platform or track over which a vehicle tire is adapted to advance. An automotive vehicle sensing device and a programmable power operated ramp or elevator are provided whereby a vehicle will activate the sensing device which is effective to raise the ramp or elevator. This results in an advancing roller dolly or pusher being deflected by the ramp onto the top platform or track where the roller dolly engages the vehicle tire and movably advances the vehicle along the track. The roller dollies do not have a low profile and do not move upwardly or downwardly relative to the top platform when the roller dolly engages the tire of the vehicle to be transported. The roller dollies do not conform to the shape of the sprocket as they move about the sprocket.

Another example of a vehicle conveyor is shown in the Hanna's U.S. Pat. No. 3,554,132, issued Jan. 12, 1971 and reissued as U.S. Pat. No. Re. 30,026 on June 12, 1979. This patent discloses an endless conveyor chain carrying roller dollies or pushers which is mounted for travel below a vehicle path. The pushers are below and are movable by a selectively operable guide to the level of the path when the guide is moved to its operative position by a remote control device.

In one embodiment of U.S. Pat. No. 3,554,132, the vehicle-engaging members or pushers include tire-engaging rollers or roller dollies secured to a conveyor chain by arms hingedly attached to the conveyor chain. The conveyor chain is located underneath a horizontal track along which a vehicle tire may be located, the track being provided with a longitudinal slot of a size for receiving the arm of the vehicle-engaging member. This slot is enlarged near the forward end of the conveyor course to provide an opening through which a tire-engaging roller may pass to the top surface of the vehicle track. Lifter means are employed for comming the roller from the course of the conveyor, below the vehicle track, upwardly along the track where the roller is then constrained to move. At this time the arm of the tire-engaging member extends through the slot in the track. Toward the end of the conveyor course, the longitudinal slot is enlarged by an opening through which the roller may drop back for return travel below the track.

The vehicle-engaging member or roller dolly of U.S. Pat. No. 3,554,132 is also provided with a second roller located between the tire-engaging roller and the chain along the arm joining the two. This second roller normally aids in carrying a vehicle engaging member along a channel underneath the vehicle track. However, when the tire-engaging roller engages the vehicle tire, this second roller may be urged upwardly to ride along the underside of the vehicle track as shown in FIG. 6 thereof.

Another example of a vehicle conveyor will be described in connection with the prior art device of FIG. 1 and is also disclosed in U.S. Pat. No. 4,374,496 to Hanna which issued Feb. 22, 1983. This prior art device includes a track upon which a roller dolly or pusher is selectively lifted. Three pairs of rollers are provided on the roller dolly. A first pair of rollers are disposed at a predetermined height above the tire track for engaging the tire of the vehicle while being conveyed along the track. The first roller pair pivots about an intermediate roller pair upon contact with a vehicle wheel to a lower position than the position of the initial engagement. The profile of the roller dolly is higher when disengaged from a vehicle tire when riding on the track than when in engagement with the vehicle tire. The roller dolly does not conform to the shape of the sprocket about which the conveyor chain is pulled.

The tire-engaging rollers in U.S. Pat. No. 4,374,496 are coextensive in width with the rollers that ride upon the track and about which the dolly pivots. The high and wide profile of the upper rollers may cause interference with wheel brushes used to clean vehicle wheels that are located close to the track. The wheel brushes are elongate, small-diameter brushes which are brought into engagement with the lower portion of the vehicle wheel as it rolls upon the track. If the dolly used to move the vehicle has a high and wide profile, the brushes may impinge upon the dolly, especially if the dolly disposed on the track but not in engagement with the vehicle wheel. Such contact with the dolly can cause unnecessary wear of the brushes and the dollies.

SUMMARY OF THE INVENTION

The present invention relates to a conveyor for transporting vehicles in one direction along a track. The conveyor uses car wheel engaging dollies attached to an endless chain. Each dolly includes an arcuate arm portion having a concavely-curved arcuate surface on the side of the arm facing the chain. The arm is hinged on a first end to a connector link of the chain by a first pin which extends through and outwardly from both sides of the chain and the arm. A first pair of rollers is secured to the ends of the pin extending from the two sides. The arm includes a second pair of rollers secured to a second end of the arm spaced from the first end. The first and second set of rollers are aligned on an arc which follows the curved arcuate surface of the arm. A third pin is disposed on the arm parallel to the first and second pins at a point intermediate the first and second pins and spaced radially outwardly from the arc on which the first and second rollers are aligned. A third pair of rollers are mounted and secured on the third pin for engaging the wheel of a vehicle to be moved by the conveyor.

A unique aspect of the present invention is that when the third pair of rollers are not in engagement with the vehicle wheel they remain in a first position as the second roller rides upon the upper surface of the track. However, when the third pair of rollers engages a vehicle wheel, the third pair of rollers raise upwardly until the first pair of rollers, located below the track, contacts the lower surface of the track. In this way, a low profile dolly is provided when the dolly is out of engagement with a vehicle wheel and a more efficient, high-profile position is assumed when the dolly engages the wheel of the vehicle to be conveyed.

According to another aspect of the present invention, the arcuate curvature of the arm of the dolly is matched to correspond to the curvature of the sprockets over which the chain rides. The curvature permits the dolly to travel about the sprockets in an arcuate path with minimum amount of space being required outwardly from the sprockets for the dollies to pass thereabout.

According to still another aspect of the present invention, the dolly, as it is moved by the chain around the sprockets, has the surface of the arm facing the chain in close proximity to the outer periphery of the sprockets whereby as the dolly travels about the sprockets, the second pair of rollers engage the chain and the third pair of rollers follows arcuate portions of the conveyor path about the sprockets and is spaced from the chain a distance less than the distance the third pair of rollers is spaced from the chain along linear portions of the conveyor path.

The connector link to which the arm of the dolly is hinged preferably comprises a pair of equilateral triangularly-shaped plates which are connected on one side to adjacent links of the chain through two holes formed in the corners of the plates and connected to the arm by a pin which extends through a third hole in the plates.

The conveyor of the present invention also includes a support rail over which the first pair of rollers move, carrying the upper run of the chain. Upon engagement of the vehicle wheel by the third roller pair, the first roller pair is lifted off of the support rail.

The conveyor also includes a lift mechanism for raising the dollies to the track level upon actuation of a control mechanism so that the dollies may remain below the track level with the second roller pair moving along the support rail if not needed, or shifted to the track level as required to convey a vehicle along the track.

The dollies of the present invention preferably include, as the third set of rollers, a pair of rollers having a reduced length which extend to a lesser extent transversely relative to the track and which are narrower than the second set of rollers which engage the upper surface of the track. The narrow rollers present less potential for interference with wheel brushes located adjacent to the track.

According to another aspect of the present invention, a method of transporting vehicles in one direction along a substantially horizontal track is disclosed. The method includes the use of an endless conveyor having a car wheel engaging dolly having an arcuate arm and three pairs of rollers. The method comprises the steps of positioning a vehicle wheel on the track, moving the dolly along the track toward the vehicle wheel in the direction of movement, engaging the vehicle wheel with a pair of rollers which roll up the vehicle wheel to a raised wheel engagement position. A first pair of rollers is pivoted about the second pair of rollers and simultaneously lifted from a support rail in response to upward shifting of the third pair of rollers into engagement with the tire.

Thus a feature of the present invention is to provide an improved dolly construction and a vehicle conveyor having dollies which efficiently transfer force to the wheel of a vehicle to be moved along the conveyor path.

Another feature of the present invention is to provide a conveyor which minimizes the space required by the conveyor vertically and along the length of the conveyor.

Still another feature of the present invention is to provide a car wash conveyor which has low profile dollies which minimize interference with wheel brush units located close to the conveyor track. This permits the wheel brushes to be positioned closer to the conveyor track and further from the wheel covers of the vehicles which reduces the chance of scratching or damaging the wheel covers.

These and other features, as well as various inherent advantages of the present invention, will be apparent from the following description in view of the accompanying drawings.

DETAILED DESCRIPTION OF THE INVENTION

Figure 1:
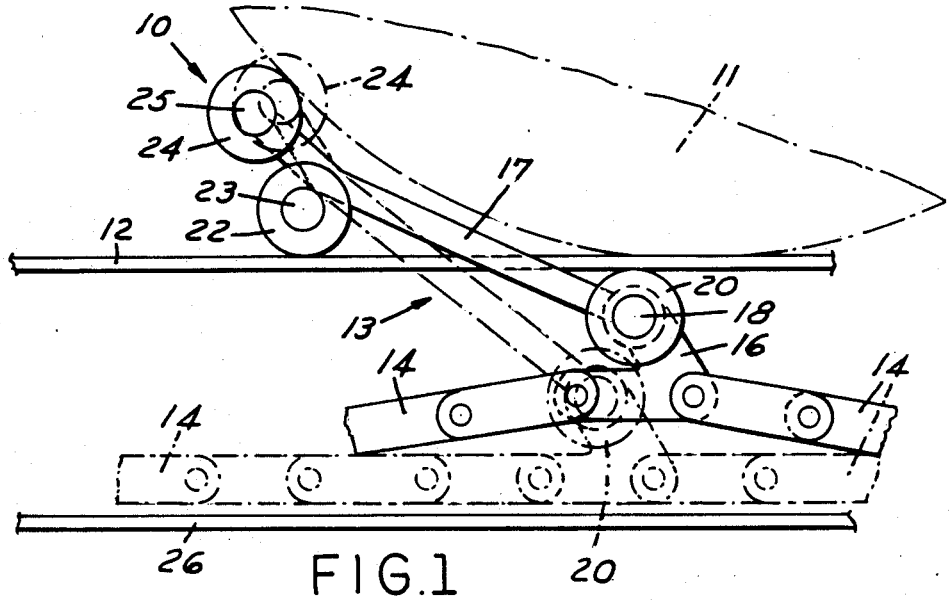
FIG.1 PRIOR ART
FIG. 1 is a fragmentary side elevational view of a prior art conveyor and dolly of the type illustrated in U.S. Pat. No. 4,374,496.

A prior art automobile conveyor 10, as illustrated and described in U.S. Pat. No. 4,374,496 is also shown in FIG. 1. The conveyor 10 has a vehicle wheel 11 thereon which is moved along a track 12 by a roller dolly or pusher 13. The motive force is provided by an endless chain 14.

The pusher or roller dolly 13 is connected to the chain 14 and includes a triangular-shaped connector link 16 which is connected to a bent plate or arm 17 by a pivot pin or shaft 18. The arm 17 extends from the connector link 16 located below the track 12 through a slot in the track 12 to a point above the track 12 and behind the vehicle wheel 11. The pivot pin or shaft 18 extends outwardly from both sides of the connector link 16 and receives lower rollers 20 on the ends of the pivot pin 18 extending from the connector link 16. The connector link 16 is preferably two triangular-shaped plates which are received on the pivot pin 18 between the lower rollers 20 and the bent plate or arm 17.

The arm 17 is made of heavy-gauge steel plate which is formed into long and short portions which intersect at an oblique angle. The short portion of the arm 17 extends at a greater angle of inclination relative to the track 12 than the remainder of the arm 17.

Track riding rollers 22 are mounted to the arm 17 at the bend in the arm 17 by an intermediate pin or shaft 23 which is welded to and extends from both sides of the arm 17. The track riding rollers 22, when in their operative position, ride upon the track 12. When in their inoperative position, the track riding rollers 22 rest upon the top surface of the endless chain 14 below the track 12 in the space between the endless chain 14 and the track 12. Tire-engaging rollers 24 are mounted on an upper end pin or shaft 25 which is secured to the opposite end of the arm 17 from the pivot pin 18.

A distinguishing aspect of the operation of the prior art roller mechanism or pusher 13 will be explained with reference to FIG. 1. In FIG. 1, the pusher 13 is shown in phantom lines in its disengaged position and in solid lines representing the pusher 13 in its position after fully engaging the vehicle wheel 11. In its disengaged position, the chain 14 rides upon a guide rail 26 located below the track 12. The lower rollers 20 are spaced from the lower surface of the track 12 while the track-riding rollers 22 and tire-engaging rollers 24 are disposed above the track 12. As the tire-engaging rollers 24 contact the vehicle wheel 11, they pivot rearwardly and downwardly about the track-riding rollers 22. This causes the connector link 16 to be lifted upwardly by the arm 17 until the lower rollers 20 engage the lower surface of the track 12. In this position, the motive force supplied by the endless chain 14 is transferred through the roller dolly or pusher 13 to the vehicle wheel 11.

Figure 2:
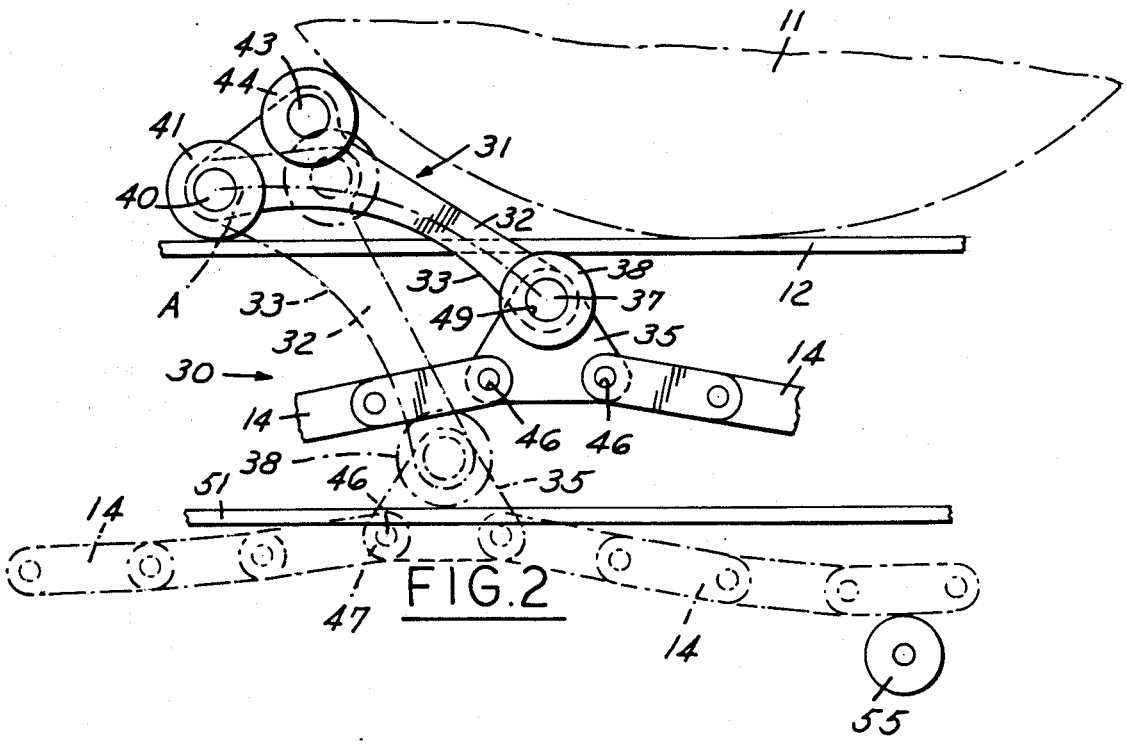
FIG. 2 is a fragmentary side elevational view of the conveyor and dolly apparatus of the present invention.

Referring now to FIG. 2, the vehicle conveyor 30 of the present invention will be described to distinguish it and its method of operation from the prior art automobile conveyor 10 described with reference to FIG. 1. A primary structural difference in the vehicle conveyor 30 of the present invention relates to the construction of the roller dolly or pusher 31. The dolly 31 includes an arcuate arm portion 32 which is characterized by an arc-shaped surface 33 on the side of the arm 32 facing the endless chain 14. The arc-shaped surface 33 is concave relative to the endless chain 14 which provides space utilization efficiencies as will be described below.

The arm portion 32 is connected to an equilateral triangular connecting link 35 by a hinge pin or shaft 37. The hinge pin 37 extends outwardly from both sides of the arcuate arm portion 32 and the triangular connecting link 35. The ends of the hinge pin 37, extending outwardly from the connecting link 35 and arm portion 32, receive lower rollers 38 which are secured thereon.

In contrast with the prior art automobile conveyor 10, the opposite end of the arcuate arm portion 32 is connected to a pivot pin or shaft 40 which extends outwardly from both sides of the arm portion 32 and receives track-engaging rollers 41 which are secured thereon. An intermediate pin or shaft 43 extends outwardly from both sides of the arcuate arm 32. The hinge pin 37 and pivot pin 40 are in arcuate alignment with each other on an arc A uniformly radially spaced from the arc-shaped surface 33. The intermediate pin 43 is located on the arcuate arm portion 32 at a point spaced radially outwardly from the arc A on which the first and second rollers are aligned.

The connecting link 35 includes two holes 46 in the lower aligned corners 47 of the connecting link 35. The holes 46 receives the connecting pins of the endless chain 14, forming a specialized link of the endless chain 14. The triangular connecting link 35 also includes a connection hole 49 formed through the outwardly extending corner of the triangular connecting link 35. The triangular connecting link 35 is preferably a pair of links as is better shown in FIGS. 4 and 5.

In operation, the lower rullers 38 support the endless chain 14 and roll upon a guide rail 51 prior to engagement with the vehicle wheel 11. The pre-engagement position is shown in phantom lines in FIG. 2. As the chain 14 continues to move from left to right in FIG. 2, the dolly 31 moves from its condition shown in phantom lines in FIG. 2 to the position shown in solid lines. As the wheel-engaging rollers 44 engage the vehicle wheel 11, the wheel-engaging rollers 44 roll upwardly and rearwardly on the vehicle wheel pivoting about the track-engaging rollers 41. This pivoting movement causes the lower rollers 38 to pivot upwardly about the track-engaging rollers 41 until they contact the lower surface of the track 12. The lower rollers 38 lift the triangular connecting link 35 and the endless chain 14 as shown in FIG. 2.

Figures 3, 4:
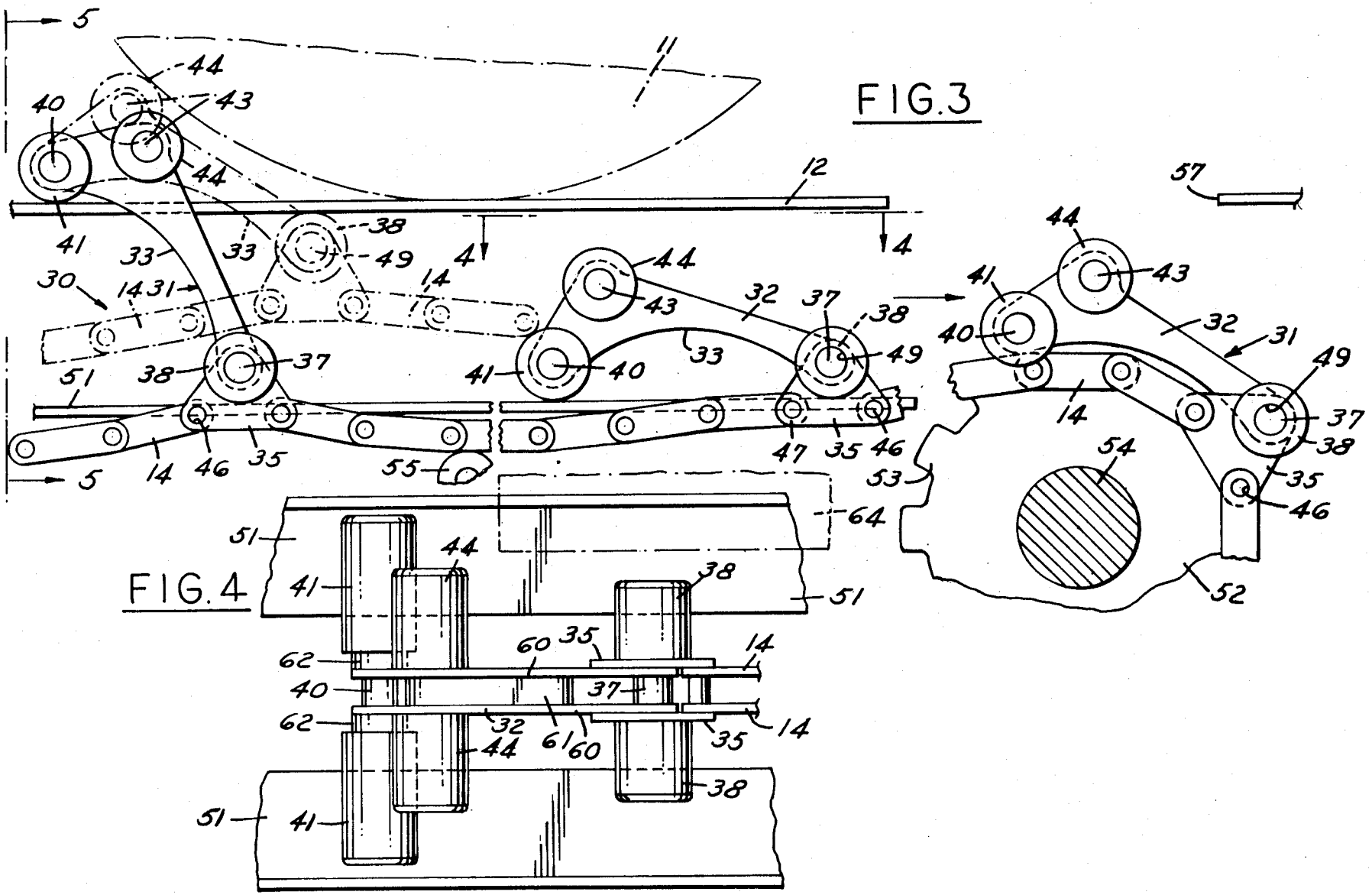
FIG. 3 is a fragmentary side elevational view of a conveyor with three dollies made according to the present invention, with parts broken away, and showing the dollies in different operational positions.
FIG. 4 is a plan view of the dolly of the present invention and a fragmentary plan view of the track upon which it rides and looking in the direction of arrows 4—4 of FIG. 3.

Referring now to FIG. 3, a more complete portion of the vehicle conveyor 30 is shown to illustrate additional features of the present invention. The disclosure of U.S. Pat. No. 4,576,098 to Belanger et al. for an automobile conveyor is hereby incorporated by reference for its disclosure of a complete conveyor system to the extent that the prior disclosure is not inconsistent with the present application.

A series of three dollies 31 are shown attached to an endless chain 14. The left-most dolly in FIG. 3 shows the dolly 31 of the present invention in its pre-engagement or non-loaded position in solid lines and in its engaged or loaded position in dotted lines. When loaded, the rollers 38 on the track or rail 51 are raised and engage the bottom surface of the upper track 12. When the chain is not loaded the rollers 44 are spaced from the upper surface of the track 51.

The middle dolly 31 in FIG. 3 is shown in the undeployed position with the track engaging rollers 41 rolling upon the guide rail 51 between the endless chain 14 and the track 12. The dollies 31 are deployed generally at the beginning of the upper run of the conveyor by a selectively interposable ramp which, upon actuation, causes the track-engaging rollers 41 to ride up a ramp and onto the track 12. If the ramp is not actuated, the dolly 31 remains below the track 12 and rolls along the guide rail 51. The weight of the chain 14 maintains the rollers 41 and 38 on the guide rail 51 when the dolly 31 is in a non-loaded or unemployed position.

The right-most dolly in FIG. 3 shows the position of the dolly 31 as it begins moving about the sprocket 52 which returns the endless chain 14. The sprocket 52 preferably has a circular periphery 53 which engages the endless chain 14. The sprocket 52 is connected to a shaft 54 which may be a drive shaft or idler shaft as is well known in the art of chain conveyors. The radius of the periphery 53 is slightly less than but generally corresponds to the radius of the arc-shaped surface 33 on the arcuate arm portion 32. The arc-shaped surface 33 is preferably matched to the periphery 53 so that the dolly 31 may pass about the sprocket 52 with the minimum clearance being required radially about the sprocket 52. By requiring less clearance, the conveyor assembly, including the housing of the conveyor, may be made slightly shorter than was required for prior art dollies. The convex shape of the surface 33 permits the arcuate arm portion 32 to hug the sprocket 52 as it moves around the sprocket 52. Chain supporting rollers 55 are provided to support the chain 14 as it is moved along the support rail 51 between the dollies 31.

The dolly 31 may reach the position of the right-most dolly in FIG. 3 by either traversing the conveyor 14, in the position shown in the middle position shown in FIG. 3, or by traversing the track 12 in the position shown in the left-most, or tire-engaging, position shown in FIG. 3. If the dolly 31 traversed the track 12 in the tire-engaging position, the dolly 31 would later drop through an opening 57 formed in the track 12. The opening 57 is preferably covered by a trap door (not shown).

Referring now to FIG. 4, the construction of the dolly 31 is shown in plan view so that the orientation and spacing of the parts may be better understood. The arcuate arm portion 32 is formed by two spaced, parallel side plates 60 that are located between the rollers 38, 41, 44. The side plates 60 are attached to and held in position by a spacer plate 61 which is preferably welded to the upper surface of the arcuate arm portion 32. The side plates 60 and spacer plate 61 provide a rigid arm which is strong and durable. The side plates 60 are formed with the arc-shaped surface 33. The side plates 60 and spacer plate 61 provides a strong structural support base for the dolly 31. The side plates 60 and spacer plate 61 are cut to shape and are not formed to their desired configuration in contrast to the bent plate or arm 17 of the prior art device described above. The track-engaging rollers 41 are preferably mounted on the pivot pin 40 on the outer side of spacers 62.

Figure 5:
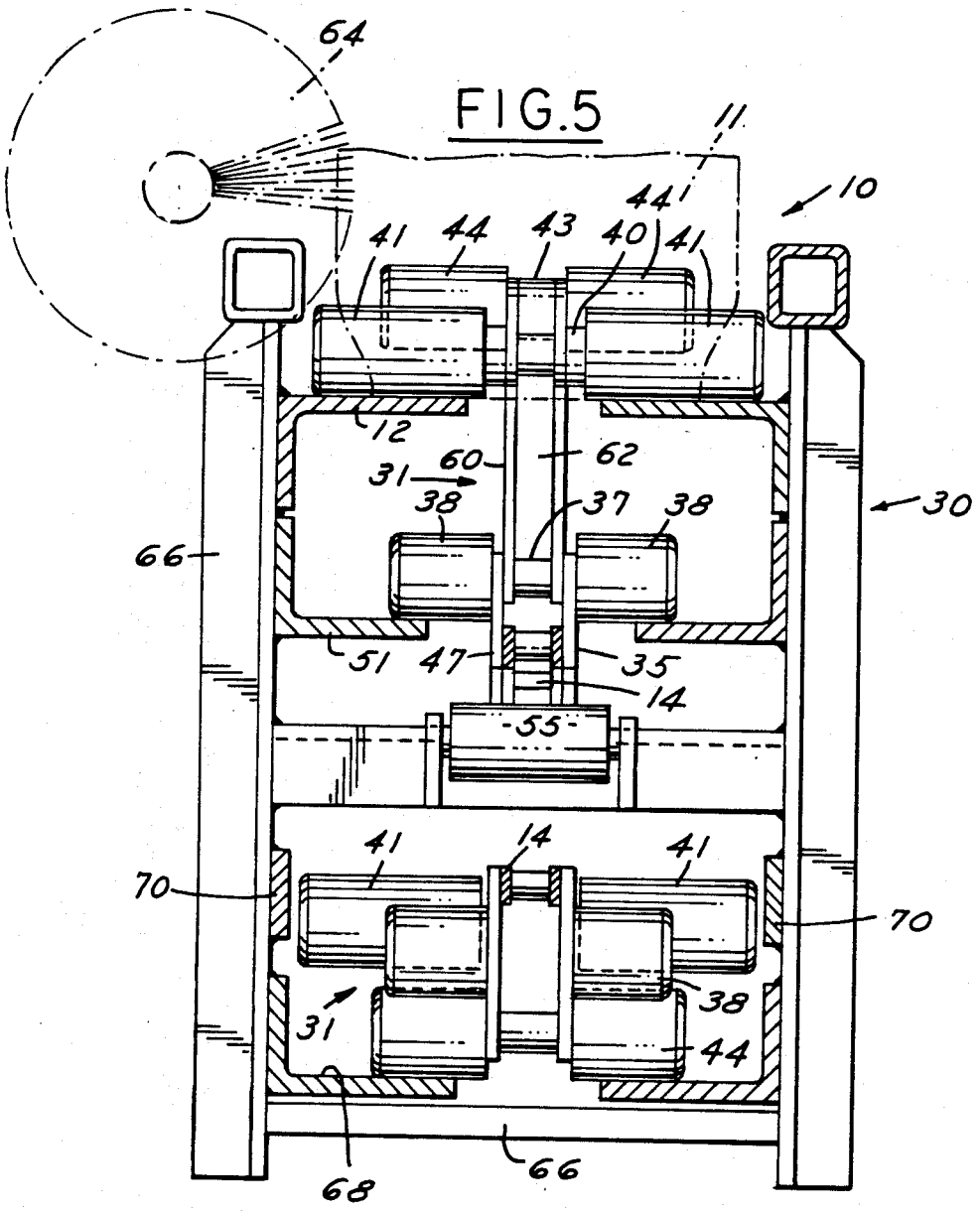
FIG. 5 is a rear elevational cross-sectional view of the conveyor and a dolly apparatus made in accordance with the present invention and looking in the direction of arrows 5—5 of FIG. 3.

One advantage of the structure of the dolly 31 of the vehicle conveyor 30 of the present invention may be better appreciated by reference to FIGS. 4 and 5 of the drawings. In FIGS. 4 and 5, a tire sidewall brush 64 is shown in phantom lines. The sidewall brush 64 is preferably deployed adjacent to the track 12 to clean vehicle wheels as they roll along the track. The sidewall brush 64 is preferably a small radius elongated brush which rotates as the tire rolls upon the track 12. It is important that the sidewall brush 64 be located in a low position close to the track 12 so that the brush 64 will not engage or damage the wheel covers. Such tire wheel covers may be formed of aluminum, chrome, or another material which may be scratched or damaged if contacted by the sidewall brush. The present invention includes wheel-engaging rollers 44 which are of reduced length as compared to the track-engaging rollers 41. As a result, the sidewall brush 64 may be located closer to the track 12 and can be of a reduced height so as to not contact the wheel covers. The track-engaging rollers 41 are wider to provide a broad base of support on the track 12 for the dolly 31. The rollers 38, 41 and 44 are made from a durable plastic material.

Referring now to FIG. 5, a cross-section of the vehicle conveyor 30, including its upper and lower runs, is shown. The conveyor 30 includes a frame 66 which supports the sprockets 52 on their respective shafts 54. The frame 66 also supports the track 12, the guide rail 51 and opposed bottom support angles 68 sometimes referred to as bottom plates or bottom support plates. The plates 68 are spaced apart throughout the length of the framework thereby providing a clearance for the centrally arranged endless sprocket chain 14. The dolly 31 travels along the upper run of the conveyor 30 moving in the direction that the vehicle transferred thereby is to be moved. Upon movement about the return sprocket, the dolly 31 is returned in the opposite direction as is well known in the art. The unique structure of the dolly 31 of the present invention permits the overall height of the frame 66 to be minimized.

The frame 66 is provided with a pair of side plates or straps 70 which are welded to the frame 66 above the bottom support plates 68 as shown in FIG. 5. The side plates 70 extend generally the length of the conveyor or framework and assist in preventing the chain and roller dollies 31 from cocking and jumping off the support angles 68 or having the rollers 41 move laterally beyond the side edges of the frame 66 and interfering with the normal operations of the conveyor system.

Referring once again to FIG. 3, it will be observed that when the roller dolly 31 is loaded, the rollers 44 rise into engagement with the tire 11. At such time, the rollers 41 and 38 engage opposite sides of the track 12.

When the dolly 31 traverses the guide rail 51 (as shown by the dolly in the middle of FIG. 3), the rollers 41 and 38 engage and ride up the same side of the rail 51. At such time, a line extending through the centers of the pins 40 and 37 is parallel to the rail 51. The third rollers are not in contact with anything and are located in a predetermined distance from the rail 51 and a shorter distance from the line extending through the centers of the pins 40 and 37.

However, once the roller dolly 31 moves around the sprocket as shown at the right of FIG. 3, the distance between the arm 32 and the chain 14 and sprocket 52 is substantially less than the distance between the arm and the chain in the preceding position. As a result thereof, the rollers 44 are closer to the chain 14 than they were in the preceding position. This minimizes the space required by the conveyor vertically and along the length of the conveyor.

It will be appreciated that there has been disclosed, in accordance with the present invention, a preferred embodiment of a vehicle conveyor made in accordance with the present invention. As will be apparent to one skilled in the art, many variations and modifications may be made in the above-described embodiment without departing from the spirit and scope of the following broad claims.

We claim:

1. A tire engaging roller dolly adapted to be connected to a chain forming part of a conveyor for transporting a vehicle in one direction along a substantially horizontal track, comprising an arm having a surface on the side of the arm adapted to face the chain, said arm being hingedly connected on a first end to a connector link of the chain by a first pin which is adapted to extend through the link and the arm, a first pair of rollers being secured to the first pin, said arm having a second pin disposed at a second end space from the first and and aligned with the first rollers, a second pair of rollers being secured to the second pin, a third pin disposed on the arm parallel to the first and second pins at a point intermediate the first and second pins and spaced from said aligned first and second rollers, said third pin having a third pair of rollers secured thereon for engaging a tire of a vehicle adapted to be moved by the conveyor, whereby said second pair of rollers is adapted to ride upon the upper surface of the track with the third pair of rollers in a first position and said first pair of rollers spaced below said track until the third pair of rollers engages the tire, and upon engaging the tire, the third pair of rollers is adapted to roll upwardly along the vehicle wheel until the first pair of rollers are pivoted about the second pair of rollers and into contact with the lower surface of the track.

2. A tire engaging roller dolly adapted to be connected to an endless chain forming part of a conveyor for transporting a vehicle in one direction along a substantially horizontal track, comprising an arcuate arm having a concavely curved arcuate surface on the side of the arm adapted to face the chain, said arm being hingedly connected on a first end to a connector link of the chain by a first pin which is adapted to extend through the link and the arm, a first pair of rollers being secured to the first pin, said arm having a second pin disposed at a second end spaced from the first end and aligned on an arc with the first rollers, a second pair of rollers being secured to the second pin, a third pin disposed on the arm parallel to the first and second pins at a point intermediate the first and second pins and spaced radially outwardly from the arc on which said first and second rollers are aligned, said third pin having a third pair of rollers secured thereon for engaging a tire of a vehicle adapted to be moved by the conveyor, whereby said second pair of rollers is adapted to ride upon the upper surface of the track with the third pair of rollers in a first position and said first pair of rollers spaced below said track until the third pair of rollers engages the tire, and upon engaging the tire, the third pair of rollers is adapted to roll upwardly along the vehicle wheel until the first pair of rollers are pivoted about the second pair of rollers and into contact with the lower surface of the track.

3. The roller dolly of claim 2 wherein said connector link is formed by a pair of equilateral, triangularly-shaped plates having three holes located in three corners of the plates, two of said holes being adapted to be connected to adjacent links of the chain and the third hole being connected by the first pin to the arm.

4. A conveyor for transporting a vehicle in one direction along a substantially horizontal track having an endless chain and at least one tire-engaging dolly connected to the chain, comprising an arm having a surface on the side of the arm facing the chain, said arm being hingedly connected on a first end to a connector link of the chain by a first pin which extends through the link and the arm, a first pair of rollers being secured to the first pin, said arm having a second pin disposed at a second end spaced from the first end and aligned with the first rollers, a second pair of rollers being secured to the second pin, a third pin disposed on the arm parallel to the first and second pins at a point intermediate the first and second pins and spaced from said aligned first and second rollers, said third pin having a third pair of rollers secured thereon for engaging the tire of a vehicle to be moved by the conveyor, whereby said second pair of rollers rides upon the upper surface of the track with the third pair of rollers in a first position and said first pair of rollers spaced below said track until the third pair of rollers engages the tire, and upon engaging the tire, the third pair of rollers rolls upwardly along the vehicle wheel until the first pair of rollers are pivoted about the second pair of rollers and into contact with the lower surface of the track.

5. The conveyor of claim 4 wherein said conveyor includes sprockets at spaced ends over which said endless chain rides as it follows a conveyor path, said dolly as it is moved by said chain around the sprockets having said surface of said arm in close proximity to the outer periphery of the sprockets, whereby as said dolly travels about said sprockets, the second pair of rollers engage the chain and the third pair of rollers follows arcuate portions of the conveyor path about said sprockets and is spaced from the chain a distance less than the distance said third pair of rollers is spaced from the chain along linear portions of the conveyor path.

6. A conveyor for transporting a vehicle in one direction along a substantially horizontal track having an endless chain and at least one tire-engaging dolly connected to the chain, comprising an arcuate arm having a concavely curved arcuate surface on the side of the arm facing the chain, said arm being hingedly connected on a first end to a connector link of the chain by a first pin which extends through the link and the arm, a first pair of rollers being secured to the first pin, said arm having a second pin disposed at a second end spaced from the first end and aligned on an arc with the first rollers, a second pair of rollers being secured to the second pin, a third pin disposed on the arm parallel to the first and second pins at a point intermediate the first and second pins and spaced radially outwardly from the arc on which said first and second rollers are aligned, said third pin having a third pair of rollers secured thereon for engaging the tire of a vehicle to be moved by the conveyor, whereby said second pair of rollers rides upon the upper surface of the track with the third pair of rollers in a first position and said first pair of rollers spaced below said track until the third pair of rollers engages the tire, and upon engaging the tire, the third pair of rollers rolls upwardly along the vehicle wheel until the first pair of rollers are pivoted about the second pair of rollers and into contact with the lower surface of the track.

7. The conveyor of claim 6 wherein said conveyor includes sprockets at spaced ends over which said chain rides as it follows a conveyor path, said sprockets having an outer periphery approximately corresponding to the radius of the curved arcuate surface of said arm, whereby as said dolly travels about said sprockets, said second pair of rollers engage the chain and said third pair or rollers follows arcuate portions of the conveyor path about said sprockets and is spaced from the chain a distance less than the distance said third pair of rollers is spaced from the chain along linear portions of the conveyor path.

8. The conveyor of claim 6 wherein said connector link is formed by a pair of equilateral, triangularly-shaped plates having three holes located in three corners of the plates, two of said holes being connected to adjacent links of the chain and the third hole being connected by the first pin to the arm.

9. The conveyor of claim 6 wherein said chain has an upper run adapted to move in said one direction, said chain being supported along the upper run by the first pair of rollers rolling upon a support rail and wherein engagement of a tire by the third pair of rollers causes said first pair of rollers to be lifted off said support rail.

10. A method of transporting vehicles in one direction along a substantially horizontal track with an endless conveyor having a tire-engaging dolly having an arcuate arm hinged on a first end to a connector link on the chain by a first pin which extends through both sides of the chain and the arm, a first pair of rollers being secured to spaced ends of the first pin, said arm having a second pin disposed on the arm at a second end spaced from the first and aligned on the arc with the first rollers, a second pair of rollers being secured to spaced ends of the second pin, a third pin disposed on the arm parallel to the first and second pins at a point intermediate the first and second pins and spaced radially outwardly from the arc on which first and second rollers are aligned, said third pin having a third pair of rollers disposed thereon for engaging the wheel of a vehicle to be moved by the conveyor, comprising the steps of:

positioning the vehicle wheel on the track;

moving the dolly along the track toward the vehicle wheel in said one direction;

engaging said vehicle wheel with the third roller pair;

rolling said third roller pair upwardly against said vehicle wheel; and lifting said first pair of rollers and pivoting them about said second pair of rollers until said first pair of rollers engages the bottom of said track.

* * * * *